US009510430B2

(12) United States Patent
So

(10) Patent No.: US 9,510,430 B2
(45) Date of Patent: Nov. 29, 2016

(54) ILLUMINATION REGULATING SYSTEM IN SYNCHRONIZATION WITH AC POWER FREQUENCY AND METHOD USING THE SAME

(71) Applicant: Yu-Sheng So, New Taipei (TW)

(72) Inventor: Yu-Sheng So, New Taipei (TW)

( * ) Notice: Subject to any disclaimer, the term of this patent is extended or adjusted under 35 U.S.C. 154(b) by 0 days.

(21) Appl. No.: 14/709,827

(22) Filed: May 12, 2015

(65) Prior Publication Data

US 2015/0334811 A1 Nov. 19, 2015

(30) Foreign Application Priority Data

May 13, 2014 (TW) ..... 103116814 A

(51) Int. Cl.
*H05B 37/02* (2006.01)

(52) U.S. Cl.
CPC ..... *H05B 37/0272* (2013.01); *H05B 37/02* (2013.01)

(58) Field of Classification Search
CPC ..... H05B 37/02
USPC ..... 315/291, 294, 297, 307, 312
See application file for complete search history.

(56) References Cited

U.S. PATENT DOCUMENTS 7,633,406 B2 * 12/2009 Miki ..... H05B 37/0272 315/312
9,351,381 B2 * 5/2016 Verfuerth ..... H05B 37/0272
2008/0265799 A1 * 10/2008 Sibert ..... H05B 37/0245 315/292
2013/0057181 A1 * 3/2013 Bernard ..... H05B 37/0245 315/312
2015/0237706 A1 * 8/2015 Ben-Moshe ..... H05B 37/0272 315/294
2015/0366039 A1 * 12/2015 Noori ..... H05B 37/0272 315/307

* cited by examiner

*Primary Examiner* — Tung X Le
(74) *Attorney, Agent, or Firm* — Alan D. Kamrath; Kamrath IP Lawfirm, P.A.

(57) ABSTRACT

An illumination regulating system in synchronization with an AC power frequency comprises: an illumination regulating device and a regulated device, wherein the illumination regulating device and the regulated device are a light source device or a remote control device respectively. A light detector of the regulated device receives a regulating light emitted from a luminous element of the illumination regulating device to make the regulated device controlled by the illumination regulating device, and wherein the illumination regulating device and the regulated device perform wireless data transmission in synchronization with an AC power frequency. The regulating light performs data transmission via an optical transmission frame, and the light source and the remote control device are respectively provided with a light source identifying information and a remote control device identifying information. The data transmission between the illumination regulating device and the regulated device includes: one-to-one, one-to-many, many-to-one, and many-to-many transmission.

20 Claims, 11 Drawing Sheets

| | | | | |
|---|---|---|---|---|
| Illumination Regulating Device A | 0 | 0 | 1 | 1 |
| Illumination Regulating Device B | 0 | 1 | 0 | 1 |
| Received | 0 | 0 | 0 | 1 |

ILLUMINATION REGULATING SYSTEM IN SYNCHRONIZATION WITH AC POWER FREQUENCY AND METHOD USING THE SAME

FIELD OF THE INVENTION

The present invention relates to an illumination regulating system and regulating method, and particularly to an illumination regulating system and method which is operated in synchronization with an alternating current power frequency.

BACKGROUND OF THE INVENTION

The illumination techniques have been extensively applied to modern life. In all kinds of surroundings, including indoor lighting and outdoor lighting, and in specific environments such as a variety of equipments, various light sources have been used to achieve the effects of illumination and radiation. As technology advances, the quality of life has been enhanced and thus people have higher requirements for illumination techniques, in which the requirements include being able to control the characteristics of light emitted from light sources, and convenient operation and regulation of light sources.

In prior art techniques, it takes complicated wiring works to achieve purposes like controlling the light sources and regulating the characteristics of light emitted by the light source. For example, turn-on operation, turn-off operation, brightness adjustment, color temperature adjustment. Furthermore, for the users, adjusting light on conventional light sources requires complex operating procedures. Also, the conventional light sources are not equipped with memory function, so the users have to memorize the characteristics of light by themselves and to determine whether the adjusted light meets the requirements. Therefore, the light adjusting function of prior art light sources is not perfect enough, so thus does not completely satisfy users.

SUMMARY OF THE INVENTION

Consequently, to achieve simple and precise illumination regulating functionality to meet users' needs is an important research topic.

Therefore, the object of the present invention is to provide an illumination regulating system and regulating method which are operated in synchronization with an alternating current power frequency to improve the problem in prior art for ease of use.

To solve the technical problems in the prior art, the technical means adopted by the present invention provides an illumination regulating system which is operated in synchronization with an alternating current power frequency, comprising:

an illumination regulating device, which is a light source device and/or a remote control device, and which is provided with a luminous element; and a regulated device, which is a light source device and/or a remote control device, and which is provided with a light detector that receives a regulating light emitted from the luminous element of the illumination regulating device in such a manner that the regulated device is controlled by the illumination regulating device, wherein the illumination regulating device and the regulated device perform wireless data transmission in synchronization with an alternating current power frequency;

wherein the data transmission between/among the luminous element and the light detector is performed by using an optical transmission frame of the regulating light, the light source is provided with a light source recognition data, and the remote control device is provided with a remote control recognition data, and wherein the data transmission between/among the illumination regulating device and the regulated device includes:

a data transmission between one regulated device and one illumination regulating device, a data transmission among one regulated device and a plurality of illumination regulating devices, a data transmission among a plurality of regulated devices and one illumination regulating device, and a data transmission among a plurality of regulated devices and a plurality of illumination regulating devices.

According to one embodiment of the present invention, the regulated device belongs to one or more groups, in which the group is a power switch group or a remote control group.

According to one embodiment of the present invention, the light source and/or the remote control device are/is provided as a routing device which is connected between/among different groups of regulated devices to regulate the regulated devices of different groups.

According to one embodiment of the present invention, the light source and/or the remote control device are/is provided as a bridging device which is for connecting the illumination regulating device and/or the regulated device to an external network.

According to one embodiment of the present invention, the regulated device is controlled by the illumination regulating device by means of transmission starting point determination, synchronization, arbitration and/or transmission error determination.

According to one embodiment of the present invention, the arbitration is for determining the regulating priority of each illumination regulating device by comparing the optical transmission frame of each luminous element.

According to one embodiment of the present invention, the setting or transferring a set of characteristic parameter of the light source is performed between/among the illumination regulating device and the regulated device, or is performed between/among the regulated devices.

According to one embodiment of the present invention, it further comprises a monitoring means which is provided for monitoring the data status of the illumination regulating device and/or the regulated device.

According to one embodiment of the present invention, the remote control device of the illumination regulating device is with the functionality of measuring brightness and/or illuminance of the luminous element of the regulated device, or with the functionality of regulating the luminous element of the regulated device by receiving a signal transmitted from an external network.

To solve the technical problems in the prior art, another technical means adopted by the present invention provides an illumination regulating method which is operated in synchronization with an alternating current power frequency, comprising:

a light receiving step of receiving, by a light detector of a regulated device, a regulating light emitted from a luminous element of a illumination regulating device, wherein the regulating light, which performs wireless transmission between/among the illumination regulating device and the regulated device by transmitting an optical transmission frame of the regulating light, is in synchronization with an alternating current power frequency; and a light controlling step of enabling the regulated device to be controlled by the illumination regulating device according to the data of the regulating light, wherein the data transmission between/among the illumination regulating device and the regulated device includes:

a data transmission between one regulated device and one illumination regulating device, a data transmission among one regulated device and a plurality of illumination regulating devices, a data transmission among a plurality of regulated devices and one illumination regulating device, and a data transmission among a plurality of regulated devices and a plurality of illumination regulating devices.

According to one embodiment of the present invention, in the light controlling step, the regulated device is controlled by the illumination regulating device by means of transmission starting point determination, synchronization, arbitration and/or transmission error determination.

According to one embodiment of the present invention, the arbitration is for determining the regulating priority of each illumination regulating device by comparing the optical transmission frame of each luminous element.

According to one embodiment of the present invention, in the light controlling step, the illumination regulating device and/or the regulated device are/is regulated by connecting the illumination regulating device and/or the regulated device to an external network.

According to one embodiment of the present invention, in the light receiving step, the data transmission between/among different groups of the illumination regulating device and/or the regulated device is performed by configuring the light source and/or the remote control device as a routing device.

According to one embodiment of the present invention, in the light receiving step, the data status of the illumination regulating device and/or the regulated device is monitored.

According to one embodiment of the present invention, it further comprises a data transferring step, wherein the data transferring step is a step of setting or transferring the characteristic parameters of the light source device between/among the illumination regulating device and the regulated device, or between/among the regulated devices.

According to one embodiment of the present invention, it further comprises a brightness/illuminance measuring step, wherein the brightness/illuminance measuring step is a step of performing brightness and/or illuminance measurement on the luminous element of the regulated device and displaying the results of the brightness and/or the illuminance measurement.

According to one embodiment of the present invention, it further comprises a group setting step, wherein the group setting step is a step of setting a plurality of illumination regulating devices and a plurality of regulated devices as belonging to a designated power switch group and/or a designated remote control device group.

According to one embodiment of the present invention, it further comprises, before the light receiving step, a carrier wave modulating step of modulating the carrier wave frequency of the regulating light based on the alternating current power frequency.

According to one embodiment of the present invention, it further comprises a carrier wave demodulating step of demodulating the carrier wave frequency of the regulating light based on the alternating current power frequency and performing wave filtering to filter the carrier wave.

By the technical means of the present invention, the illumination regulating device and the regulated device perform wireless data transmission in synchronization with an alternating current power frequency via an optical transmission frame of the regulating light emitted from the illumination regulating device, in which the complex wiring works are saved. Furthermore, by memorizing the characteristics of light, the present invention enables convenient way of precisely regulating the light emitted from the regulated device. The illumination regulating device and the regulated device of the present invention can be a light source device, and can also be a remote control device. The data transmission between the illumination regulating device and the regulated device includes one-to-one transmission, one-to-many transmission, many-to-one transmission, and many-to-many transmission, and the data transmission further includes data transferring as well as determining and monitoring the data transmission by various mechanisms. Therefore, the present invention provides diverse ways of illuminance regulation with high accuracy.

The present invention is further explained by the description of the embodiments and the appended drawings presented below.

DETAILED DESCRIPTION OF THE PREFERRED EMBODIMENTS

Figure 1A:
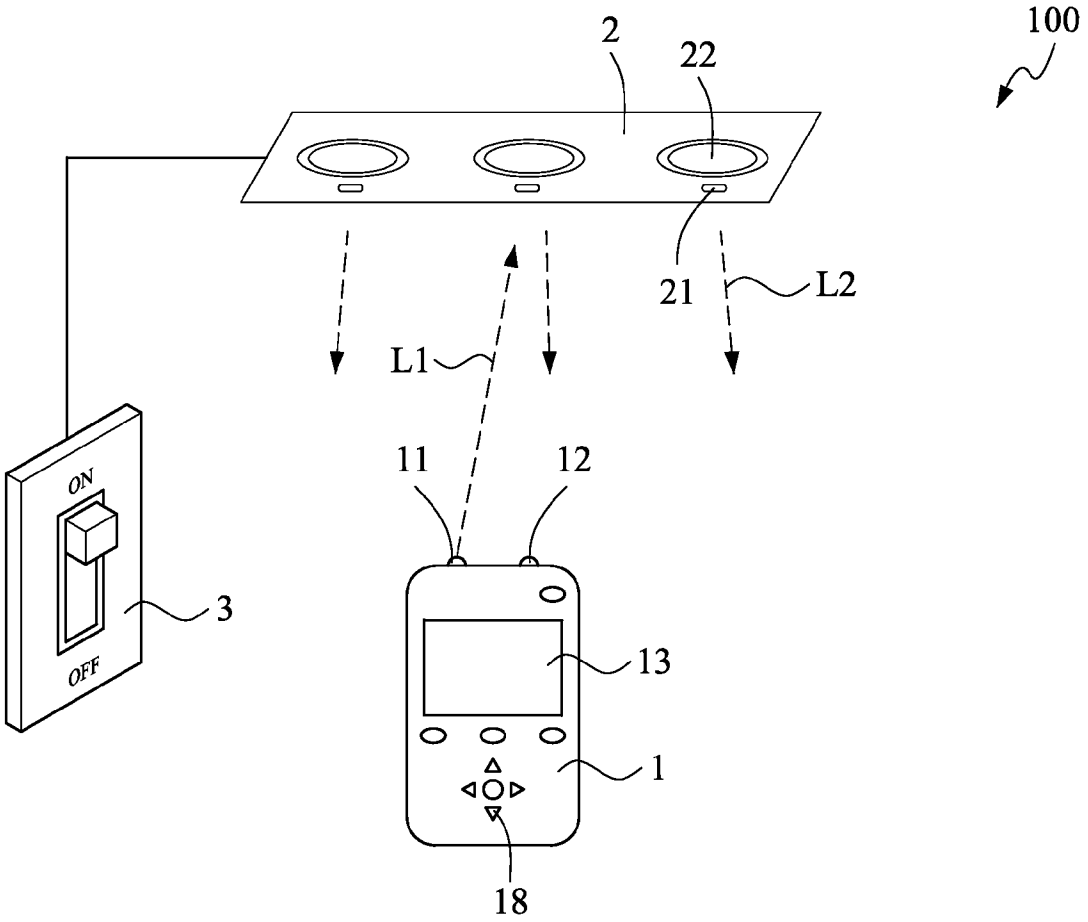
FIG. 1A is a structural diagram of an illumination regulating system according to the first embodiment of the present invention.
Figure 1B:
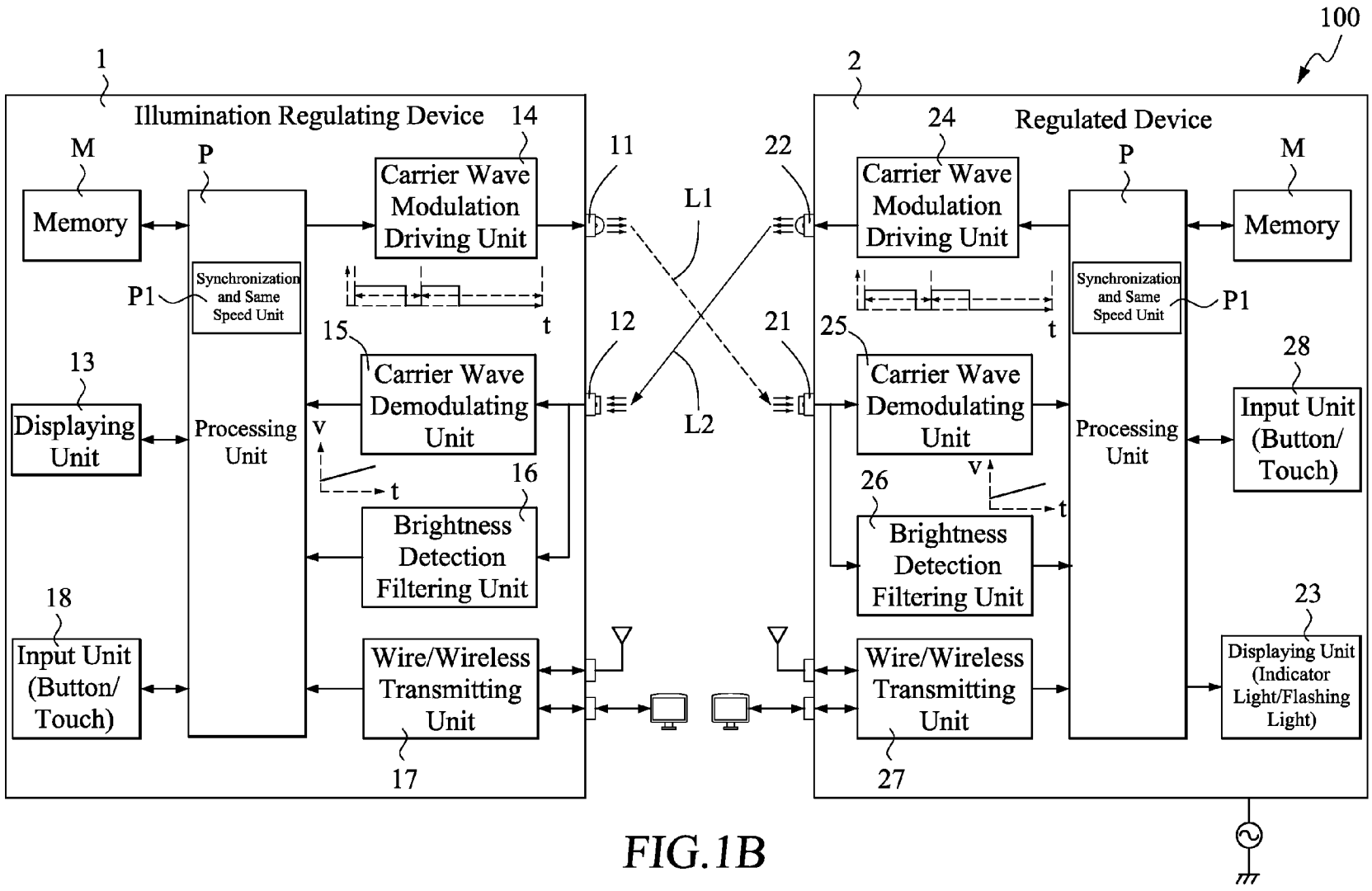
FIG. 1B is a block diagram of the illumination regulating system according to the first embodiment of the present invention.

Please refer to FIG. 1A and FIG. 1B. According to the first embodiment of the present invention, an illumination regulating system 100 which is operated in synchronization with an alternating current power frequency comprises one illumination regulating device 1 and one regulated device 2. The illumination regulating device 1 comprises a luminous element 11 and a light detector 12, and the regulated device 2 comprises a light detector 21 and a luminous element 22. In the present embodiment, the illumination regulating device 1 is a remote control device, and the regulated device 2 is a light source. The regulated device 2 is electrically connected to a power switch 3. The position of the light detector 21 can be at the outside or inside of the luminous element 22, and can also be on the lamp frame of the luminous element 22. In some of the embodiments, the luminous element 11, 22 and light source of the present invention can be a kind of LED (Light-Emitting Diode). LEDs have the advantage of energy and environment conservation, and have now become the main trend in lamp business. The present invention further utilizes LEDs combined with wireless data transmission technique to achieve the effect of illumination regulation, and thereby enhances LEDs' efficacy of energy conservation and environment conservation.

Figure 5:
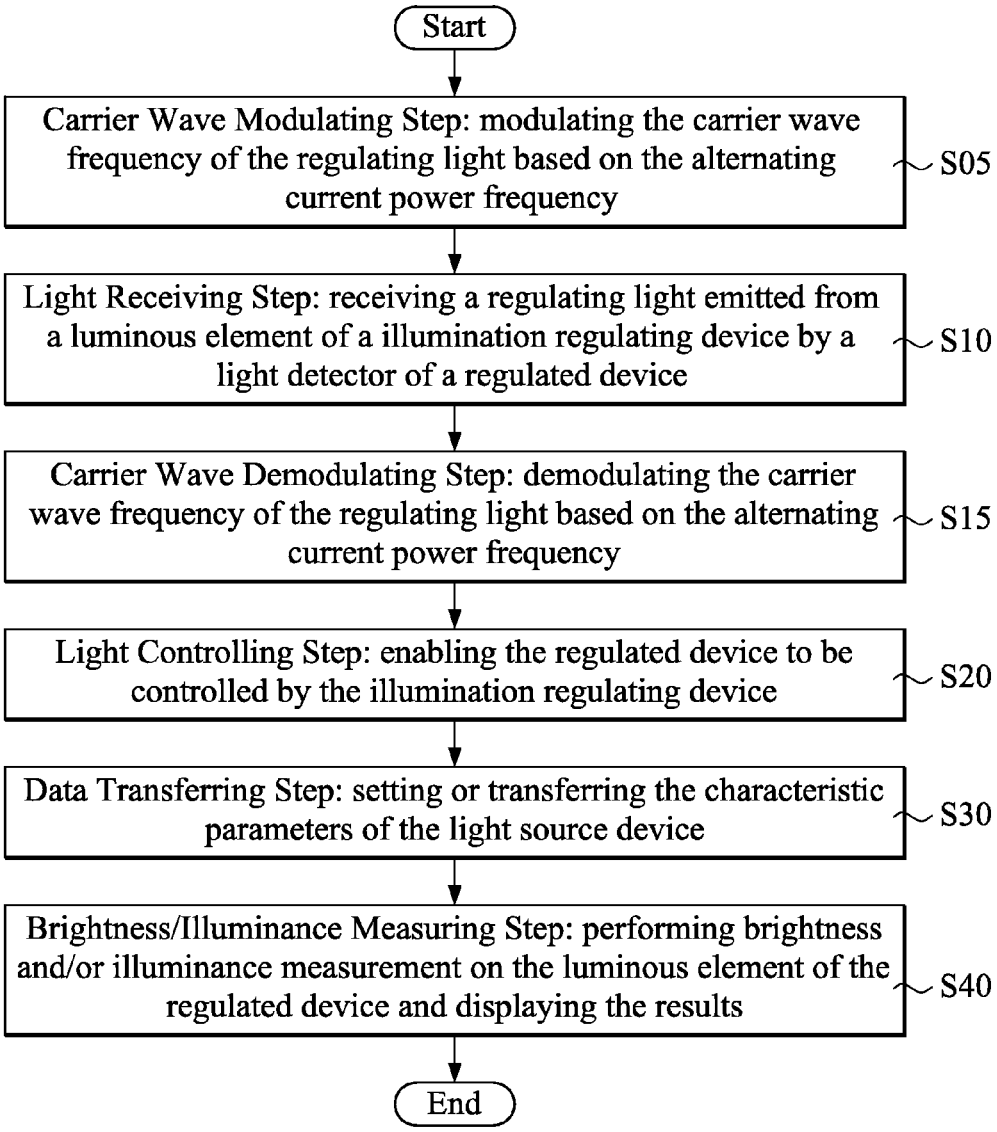
FIG. 5 is a flow diagram of the illumination regulating method according to the present invention.
Figure 6:
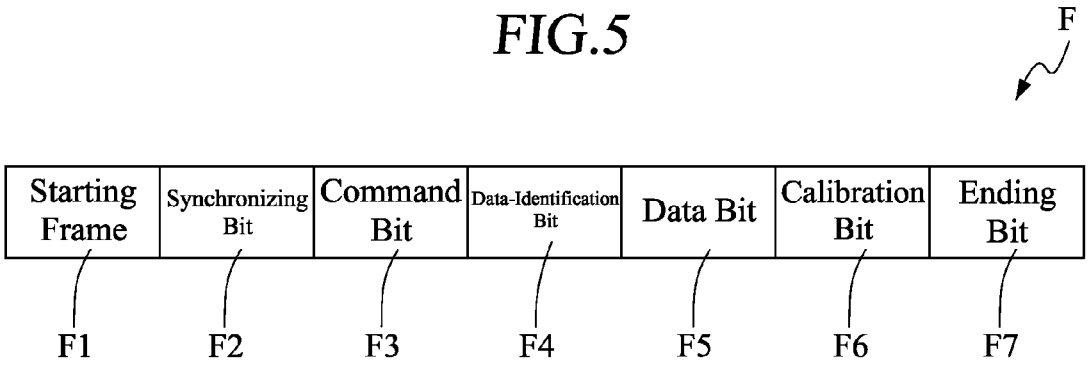
FIG. 6 is a schematic diagram of the optical transmission frame of the illumination regulating system according to the present invention.

Please refer to FIG. 5 along with FIG. 1A and FIG. 1B. The illumination regulating method operated in synchronization with an alternating current power frequency according to the first embodiment of the present invention comprises steps as follows:

First of all, a light receiving step S10 of receiving, by a light detector 21 of a regulated device 2, a regulating light L1 emitted from a luminous element 11 of a illumination regulating device 1, wherein the regulating light L1 which performs wireless transmission between/among the illumination regulating devices and the regulated devices by transmitting an optical transmission frame of the regulating light, is in synchronization with an alternating current power frequency. Specifically, the following are examples of the regulating light L1 in synchronization with an alternating current power frequency: (1) Under the circumstances that the illumination regulating device 1 and the regulated device 2 are both connected to an alternating current power (for example a light source to a light source), the regulating light L1 is synchronized (in speed) with the illumination regulating device 1. (2) Under the circumstances that the illumination regulating device 1 is connected to an alternating current power, and the regulated device 2 is not (for example, a light source to a remote control device), the regulating light L1 is synchronized (in speed) with the illumination regulating device 1. (3) Under the circumstances that the illumination regulating device 1 is not connected with an alternating current power, and the regulated device 2 is (for example, a remote control device to a light source), the regulating light L1 is synchronized (in speed) with the regulated device 2. (4) Under the circumstances that both the illumination regulating device 1 and the regulated device 2 are not connected to an alternating current power (for example, a remote control device to a remote control device), the regulating light L1 is synchronized (in speed) with the illumination regulating device 1 or the regulated device 2 alternatively. In the present embodiment, the data transmission between the regulated device 2 and the illumination regulating device 1 is the transmission between one single regulated device 2 and one single illumination regulating device 1, wherein the illumination regulating device 1 and the regulated device 2 are provided with a processing unit P respectively, and wherein the processing unit P includes a synchronization and same speed unit P1, by which the illumination regulating device 1 and the regulated device 2 are in synchronization with an alternating current power frequency or running at the same speed according to the alternating current power frequency.

The optical transmission frame F specifically includes one or more selected from a group comprising: a starting frame F1, a synchronizing bit F2, a command bit F3, a data identification bit F4, a data bit F5, a calibration bit F6, and an ending bit F7. The starting frame F1 is for enabling the luminous element 22 of the regulated device 2 to synchronize with or at the same speed with the light detector 12 of the illumination regulating device 1. The starting frame F1 includes the starting recognition of the transmitting packet from the optical transmission frame F, and the information regarding which device, the regulated device 2 or the illumination regulating device 1, is the basis of synchronization. The synchronizing bit F2 is for confirming if the synchronization columns of the data read/received by the sending party (the illumination regulating device 1) and the receiving party (the regulated device 2) is the same. If the synchronization columns are not the same, then it shows that the illumination regulating device 1 and the regulated device 2 are non-synchronized or there exists interference between the illumination regulating device 1 and the regulated device 2, in which case the illumination regulating device 1 stops data transmitting and the regulated device 2 terminates data receiving until the next transmission. The command bit F3 includes a data length, a transmitting direction, and a corresponding control and setting. The data-identification bit F4 is for the mutual recognition between the illumination regulating device 1 and the regulated device 2, and provides the identification information of the switch group address, the remote control device group address, and so on. In the present embodiment, the data-identification bit F4 of the illumination regulating device 1 is provided with a remote control identifying information for the regulated device 2 to identify the illumination regulating device 1 emitting the regulating light L1, and the data-identification bit F4 of the regulated device 2 is provided with a light source identifying information for the regulated device 2 to be recognized. The data bit F5 contains mainly characteristic parameters, which includes: automatic illuminance adjusting, manual illuminance adjusting, color hue and color temperature adjusting and setting, night light, light on/off timing, automatic illuminance setting, and so on. The calibration bit F6 is mainly for checking or calibrating the data transmission or possible error when saving data, and thereby confirming the accuracy of the transmitted packet of the optical transmission frame F. The ending bit F7 is for confirming that the signals between the transmitting packets of the optical transmission frame F is effectively segregated, and for ensuring there is no interference noise source, and under the above circumstances the next packet transmission is permitted. The illumination regulating device 1 and the regulated device 2 are respectively provided with a memory M in which all the data included in the optical transmission frame F can be stored. In a further preferred embodiment, the illumination regulating device 1 is disposed with an input unit 18; for instance, a button input unit or a touch input unit, which enables the users to set or update the data of the optical transmission frame F manually. Similarly, the regulated device 2 can also be disposed with an input unit 28 (FIG. 4A), which enables the users to set or update the characteristic parameters manually.

Next, a light controlling step (step S20) of enabling the regulated device 2 to be controlled by the illumination regulating device 1 according to the data of the optical transmission frame F of the regulating light L1 is performed.

For example, the regulated device 2 can be controlled by the illumination regulating device 1 according to the data bit F5, and thus the regulated device 2 accordingly changes its characteristic parameters such as automatic illuminance adjusting, manual illuminance adjusting, color hue and color temperature adjusting and setting, night light, light on/off timing, automatic illuminance setting, wherein the processing units P of the illumination regulating device 1 and the regulated device 2 can respectively process the data of optical transmission frame F stored in the memory M and accordingly change the illumination status of luminous elements 11 and 22, thereby regulating the characteristics of light.

In the above-mentioned light controlling step (step S20), the regulated device 2 is controlled by the illumination regulating device 1 by means of transmission starting point determination, synchronization, and/or transmission error determination. Specifically, the transmission starting point determination is a mechanism for, via the starting frame F1 determining which device, regulated device 2 or illumination regulating device 1, is the basis of synchronization. The synchronization is a mechanism for confirming if the synchronization columns of the illumination regulating device 1 and the regulated device 2 are identical; if not, the data transmission and illumination regulation are terminated. The transmission error determination is a mechanism for, via the calibration bit F6 checking or calibrating data transmission or possible error when saving data. If an error occurs, the data transmission is stopped, or the actions of the light source and remote control are terminated, or the data transmission will restart.

Next, the data transferring step (step S30) is performed which is a step of setting or transferring the characteristic parameters of the light source device between/among the illumination regulating devices 1 and the regulated devices 2. That is to say, the regulated device 2 can further download and set one or more selected from a group comprising the starting frame F1, the synchronizing bit F2, the command bit F3, the data-identification bit F4, the data bit F5, the calibration bit F6, and the ending bit F7 of the optical transmission frame F. Furthermore, a light L2 emitted from the luminous element 22 of the regulated device 2 can act as a regulating light which includes an optical transmission frame F, by which the setting or transferring of the characteristic parameters of the light source can be performed by transferring data from the light source to the remote control device. However, the present invention is not limited to this, the setting or transferring of the characteristic parameters of the light source can also be transferred from light sources to other light sources, from remote control devices to light sources, or from remote control devices to other remote control devices.

Next, a brightness/illuminance measuring step (step S40) is performed, which is a step of performing brightness and/or illuminance measurement on the light L2 emitted from the luminous element 22 of the regulated device 2 and displaying the results of the brightness and/or the illuminance measurement. The light detector 12 of the illumination regulating device 1 designated as a remote control device can detect light L2, and thus can enable the illumination regulating device 1 to perform the brightness and/or illuminance measurement of the luminous element 22 of the regulated device 2. The results of the brightness and/or the illuminance measurement can further be displayed on a displaying unit 13 of the illumination regulating device 1 by way of the processing unit P.

Besides, in the present embodiment, the illumination regulating system 100 further comprises a monitoring means (not shown in the drawings) which is provided for monitoring the data status of the illumination regulating device 1 and/or the regulated device 2 in the light receiving step (step S10), the light controlling step (step S20), the data transferring step (step S30), and the brightness/illuminance measuring step (step S40). For example, the monitoring means can monitor the data status of the illumination regulating device 1 and the regulated device 2 in the above steps by way of the regulating light L1 and light L2. Alternatively, the monitoring means can monitor the data status of the illumination regulating device 1 and the regulated device 2 in the above steps by way of electrically connected to the illumination regulating device 1 and the regulated device 2.

In a further preferred embodiment, before the light receiving step (step S10), it further comprises a carrier wave modulating step (step S05) of modulating the carrier wave frequency of the regulating light L1 based on the alternating current power frequency. This carrier wave frequency utilizes the multiplied frequency of the alternating current power frequency as the basis of modulation to uniformly modulate the carrier wave frequency of a plurality of light sources and remote control devices. After the light receiving step (step S10), it further comprises a carrier wave demodulating step (step S15) of demodulating the carrier wave frequency of the regulating light L1 based on the alternating current power frequency and performing wave filtering to filter the carrier wave. On the basis of the alternating current power frequency, in the carrier wave demodulating step, the carrier waves are filtered off precisely, and thus the unnecessary noises are filtered out, preventing the devices from receiving frames that are not the optical transmission frame, which affects the subsequent determination mechanism and leads to error. The illumination regulating device 1 and the regulated device 2 can respectively include a carrier wave modulation driving unit 14, 24, a carrier wave demodulating unit 15, 25, a brightness detection filtering unit 16, 26, a wireless/wire transmitting unit 17, 27, and can respectively perform modulation of carrier wave and the output thereof, the demodulation of carrier wave, the brightness detection filtering, and the wireless/wire transmission by means of the processing unit P according to the retrieved data of the optical transmission frame F stored in the memory M. In a further preferred embodiment, the regulated device 2 can also be disposed with a displaying unit 23, by which the status of the regulated device 2 is displayed in the form of indicating lamps, flashers and so on.

Noticeably, in other embodiments, the illumination regulating device 1 can be a light source, and the regulated device 2 can be a remote control device. In this way, via the technique of the present invention, the remote control device can be regulated by the light source via light L2, or by the technical means of the present invention, the data transmission and regulation between/among the light sources and the light sources (as depicted in FIG. 4A) can be achieved, or the data transmission and regulation between/among the remote control devices and the remote control devices can be achieved by the technique of present invention (as depicted in FIG. 4A).

Figure 4A:
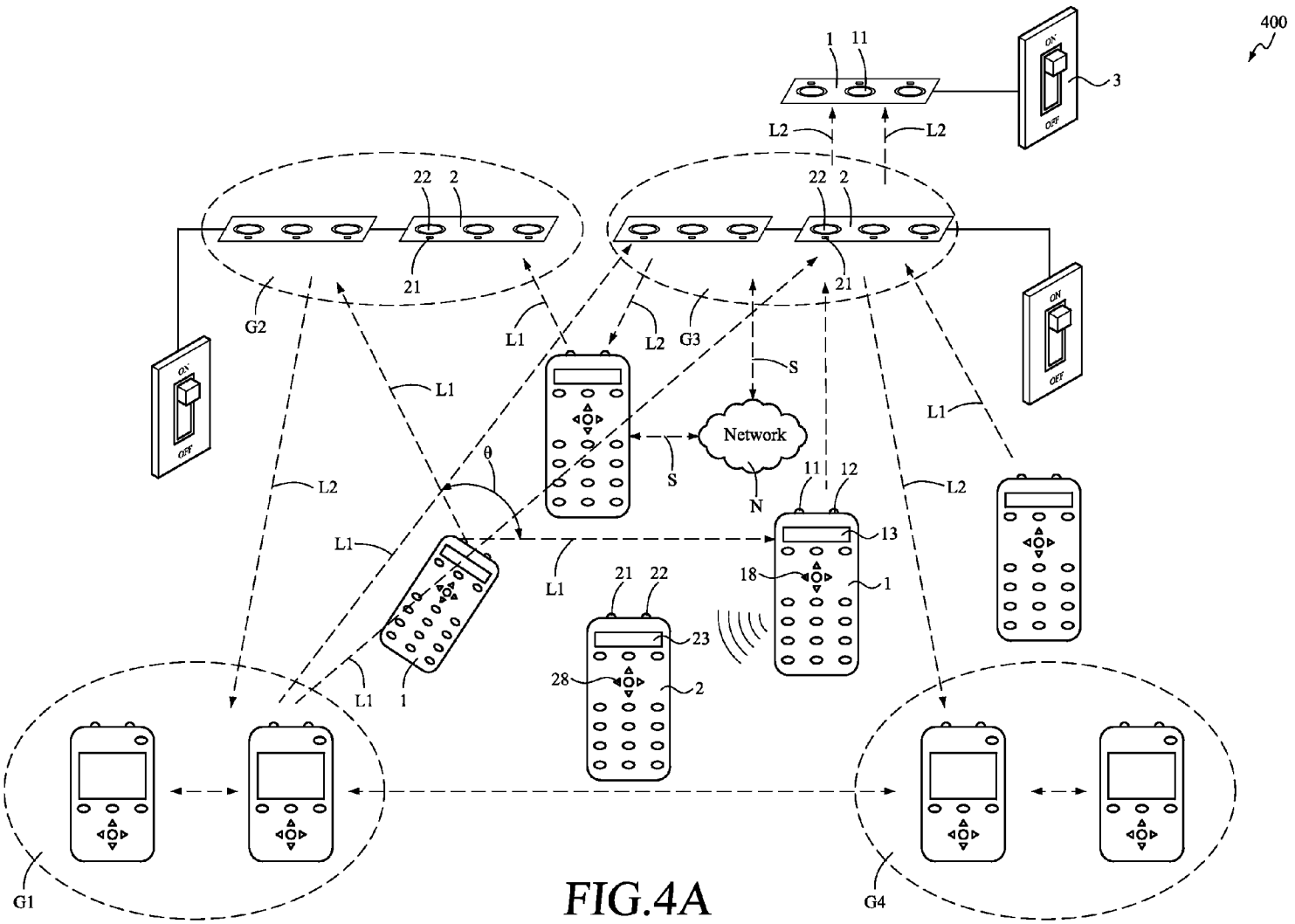
FIG. 4A is a structural diagram of the illumination regulating system according to the fourth to eighth embodiments of the present invention.

In a further preferred embodiment, as depicted in FIG. 4A, the illumination regulating device 1 and/or the regulated device 2 are/is provided as a bridging device which is for connecting the illumination regulating device 1 and/or the regulated device 2 to an external network, thereby through the external network receiving a control signal S to regulate the light source or the remote control device. However, the present invention is not limited to this. An external device (not shown) can as well monitor the data status of the illumination regulating device 1 and the regulated device 2 via an external network.

Figure 2A:
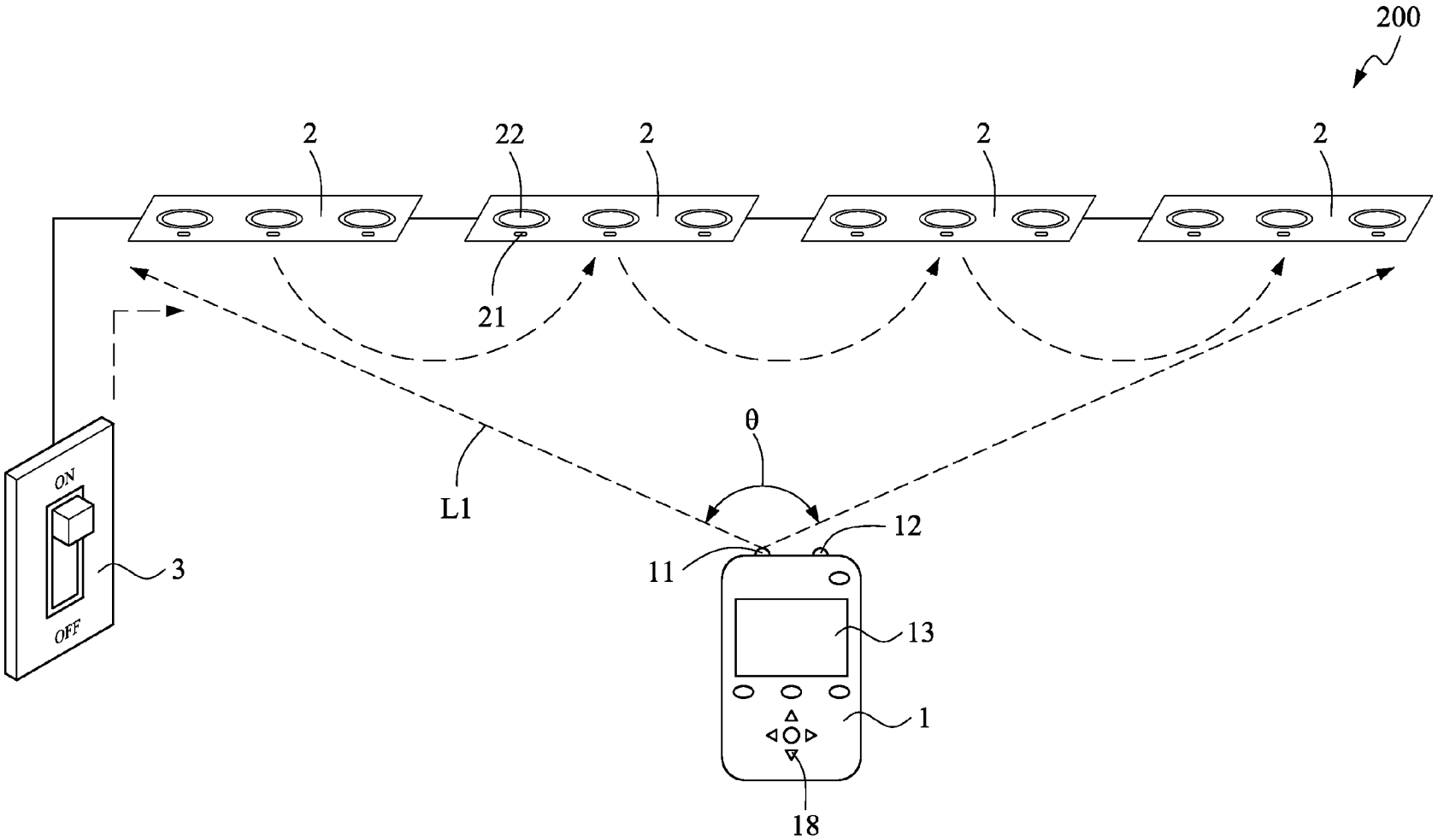
FIG. 2A is a structural diagram of the illumination regulating system according to the second embodiment of the present invention.
Figure 2B:
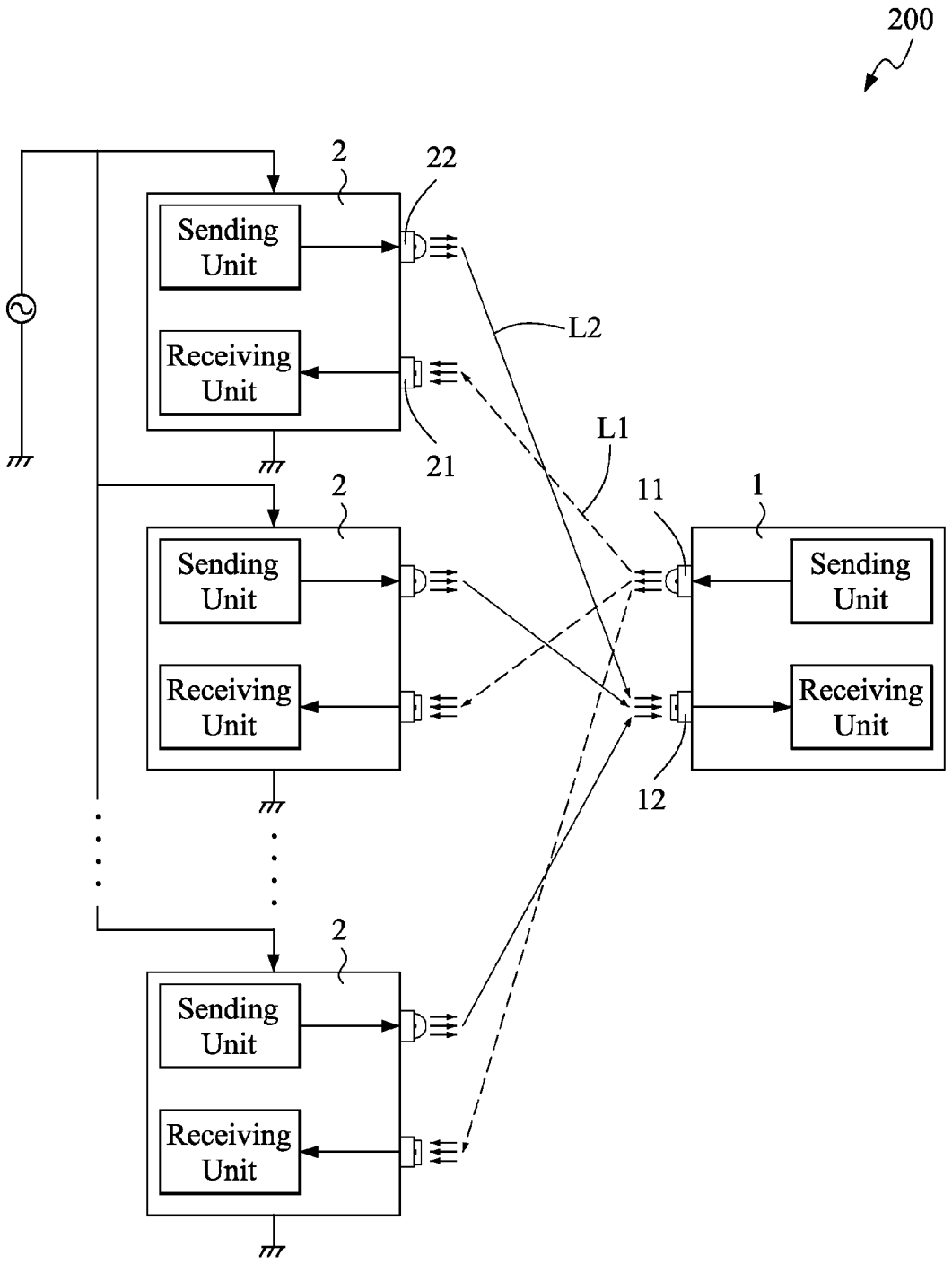
FIG. 2B is a block diagram of the illumination regulating system according to the second embodiment of the present invention.

Please refer to FIG. 2A and FIG. 2B. According to the second embodiment of the present invention, an illumination regulating system 200 which is operated in synchronization with an alternating current power frequency comprises one illumination regulating device 1 and a plurality of regulated devices 2. In the present embodiment, the data transmission between/among the regulated device 2 and the illumination regulating device 1 is the data transmission between/among a plurality of regulated devices 2 and one illumination regulating device 1. The components and the actuation principle of the illumination regulating system 200 in the present embodiment is similar to the illumination regulating system 100 of the first embodiment, and the differences between them are: in the light receiving step (step S10), by setting the light emission angle θ of the regulating light L1 of the luminous element 11 of the illumination regulating device 1, the optical transmission frame F can be received by a plurality of regulated devices 2, while in the light controlling step (step S20), it only takes only operation by one illumination regulating device 1 to control a plurality of regulated devices 2. In the data transferring step (step S30), the setting or transferring of the characteristic parameters of the light source can also be performed between/among a plurality of regulated devices 2, thereby enabling the regulated device 2 to download and setting the data of the optical transmission frame F from one single illumination regulating device 1 by performing one operation. Besides, the setting or transferring of the characteristic parameters of the light source can also be performed between/among a plurality of regulated devices 2. Alternatively, the setting or transferring of the characteristic parameters of the light source can also be performed by switching on and off the power switch 3 a predetermined number of times. In the present embodiment, the illumination regulating device 1 is a remote control device, and the plurality of regulated devices 2 are of one light source. Certainly, the present invention is not limited to this. For example, a remote control device can perform illumination regulation and data transferring with respect to a plurality of remote control devices and light sources. or a light resource can perform illumination regulation and data transferring with respect to a plurality of remote control devices and light sources.

Moreover, as depicted in FIG. 4A, in other embodiments, a plurality of regulated devices 2 belong to a remote control device group G1. Besides, a plurality of regulated devices 2 can belong to different switch group G2, G3. In a further preferred embodiment, the illumination regulating device 1 and/or the regulated devices 2 are/is provided as a routing device which is connected between/among different groups of remote control device groups G1, G4 and different groups of switch groups G2, G3, and thereby in the light receiving step (step S10) transmit the data between/among the illumination regulating device 1 and/or the regulated devices 2 of different groups of remote control device groups G1, G4 and different groups of switch groups G2, G3, and furthermore, in the light controlling step (step S20) regulate a plurality of regulated devices 2 of different groups of switch groups G2, G3. Certainly, the present invention is not limited to this. In other embodiments, the regulated devices 2 can also belong to a plurality of switch groups, and can turn on or turn off the regulated devices 2 of the other switch groups by means of switching on and off the power switch 3 of one of the switch group.

Figure 3A:
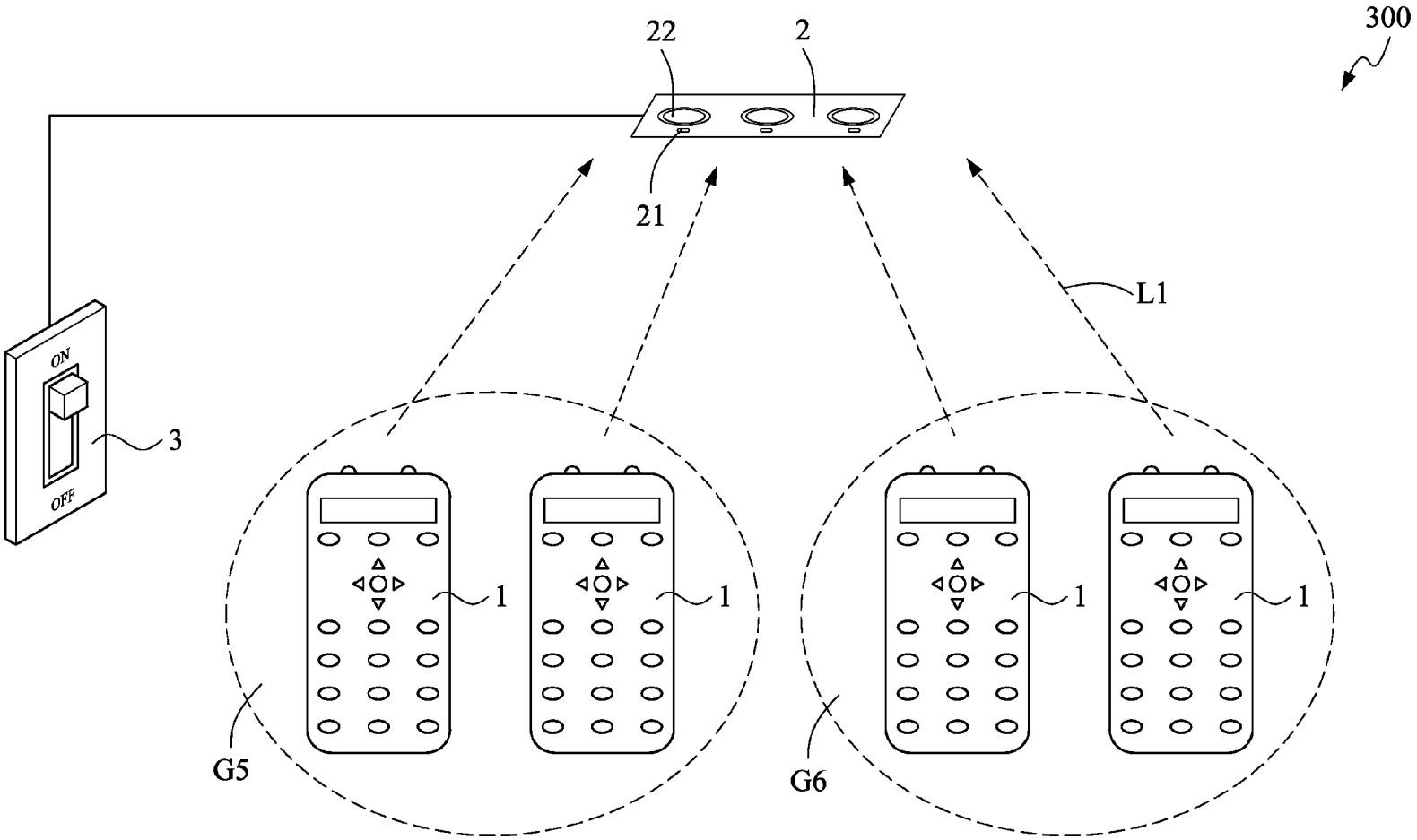
FIG. 3A is a structural diagram of the illumination regulating system according to the third embodiment of the present invention.
Figure 3B:
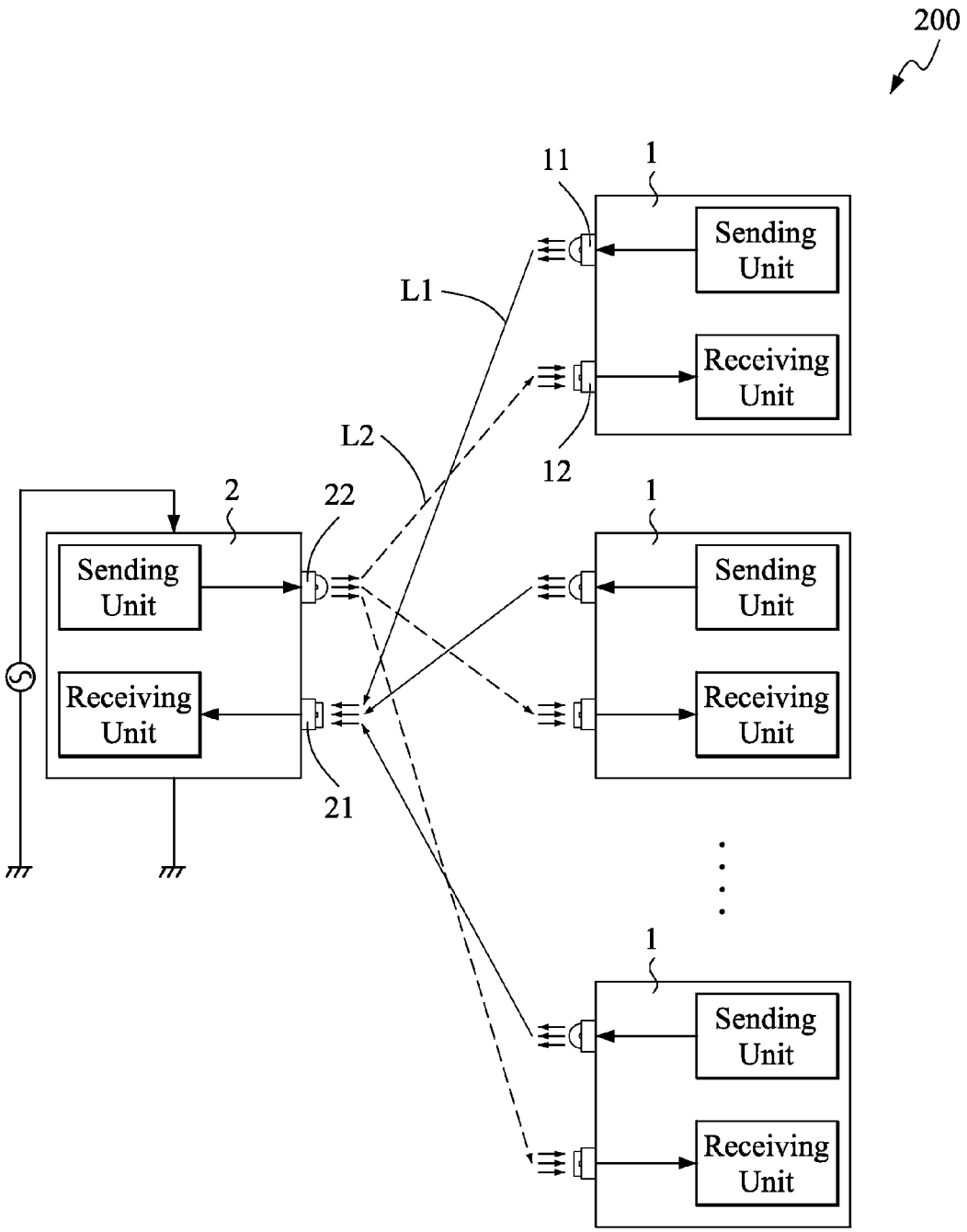
FIG. 3B is a block diagram of the illumination regulating system according to the third embodiment of the present invention.

Please refer to FIG. 3A and FIG. 3B. According to the third embodiment of the present invention, an illumination regulating system 300 which is operated in synchronization with an alternating current power frequency comprises a plurality of illumination regulating device 1 and one regulated device 2. In the present embodiment, the data transmission between/among the regulated device 2 and the illumination regulating device 1 is the data transmission between/among one single regulated device 2 and a plurality of illumination regulating device 1. The difference between the illumination regulating system 300 of the present embodiment and the illumination regulating system 100, 200 lies in: in the present embodiment, the regulated device 2 belongs to a plurality of remote control device groups G5, G6. In other words, a plurality of illumination regulating device 1 of a plurality of remote control device groups G5, G6 can all perform illumination regulation and data transfer with respect to the regulated device 2.

Figure 4B:
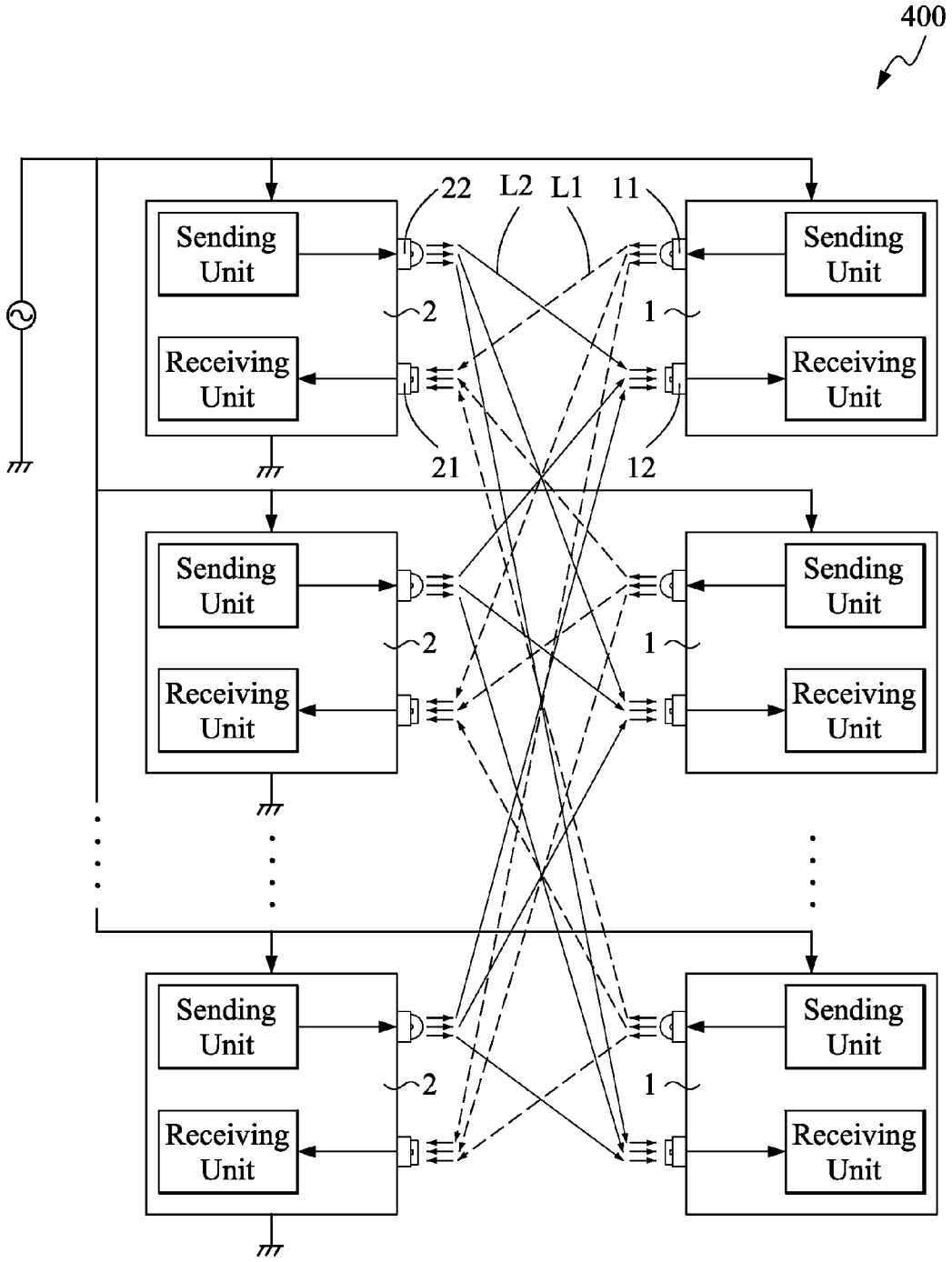
FIG. 4B is a block diagram of the illumination regulating system according to the fourth embodiment of the present invention.

Please refer to FIG. 4A and FIG. 4B. According to the fourth embodiment of the present invention, an illumination regulating system 400 which is operated in synchronization with an alternating current power frequency comprises a plurality of illumination regulating device 1 and a plurality of regulated device 2, wherein the data transmission between/among the regulated device 2 and the illumination regulating device 1 is the data transmission between/among a plurality of regulated devices 2 and a plurality of illumination regulating device 1. The difference between the illumination regulating system 400 of the present embodiment and the illumination regulating system 100, 200, 300 lies in: in the light receiving step (step S10), by means of the setting of the light emission angle θ of the regulating light L1 of the luminous element 11 of the illumination regulating device 1, a plurality of optical transmission frames F can be received by a plurality of illumination regulating devices 1 and a plurality of regulated devices 2; however, in the light controlling step (step S20), a plurality of illumination regulating devices 1 can control a plurality of regulated devices 2. In the data transferring step (step S30), the setting or transferring of the characteristic parameters of the light source can be performed between/among a plurality of illumination regulating device 1 and a plurality of regulated devices 2, thereby enabling the regulated device 2 to download and setting the data of the optical transmission frame F from one single illumination regulating device 1 by performing one operation. In the present embodiment, the illumination regulating device 1 is a remote control device, and the regulated devices 2 is a light source. Certainly, the present invention is not limited to this. For example, part of the illumination regulating devices 1 can be a light source, and part of the regulated devices 2 can be a remote control device.

In the light controlling steps (step S20) of the above embodiments, the regulated device 2 can further be controlled by the illumination regulating device 1 by means of arbitration. The arbitration mechanism determines the regulating priority of each illumination regulating device 1 by comparing the optical transmission frame F of the luminous element 11 of each illumination regulating device 1. For example, the illumination regulating device 1 with the optical transmission frame F that has a command bit F3, a data-identification bit F4, or a data bit F5 as the Most Significant Bit (MSB) will be designated the regulating priority for regulating the regulated device 2. Furthermore, the illumination regulating devices 1 which are arbitrated by the arbitration as non-priority illumination regulating devices will turn into regulated devices 2 and will be regulated by the illumination regulating device 1 with the regulating priority. The regulating priority determined by the arbitration is based on the setting of the characteristic parameters of the optical transmission frame F. In some embodiments, the arbitration can apply to a plurality of illumination regulating devices 1 in one common switch group or in one common remote control group. In some embodiments, the arbitration can apply to a plurality of illumination regulating devices 1 in different switch groups and/or in different remote control groups.

Figure 7A:
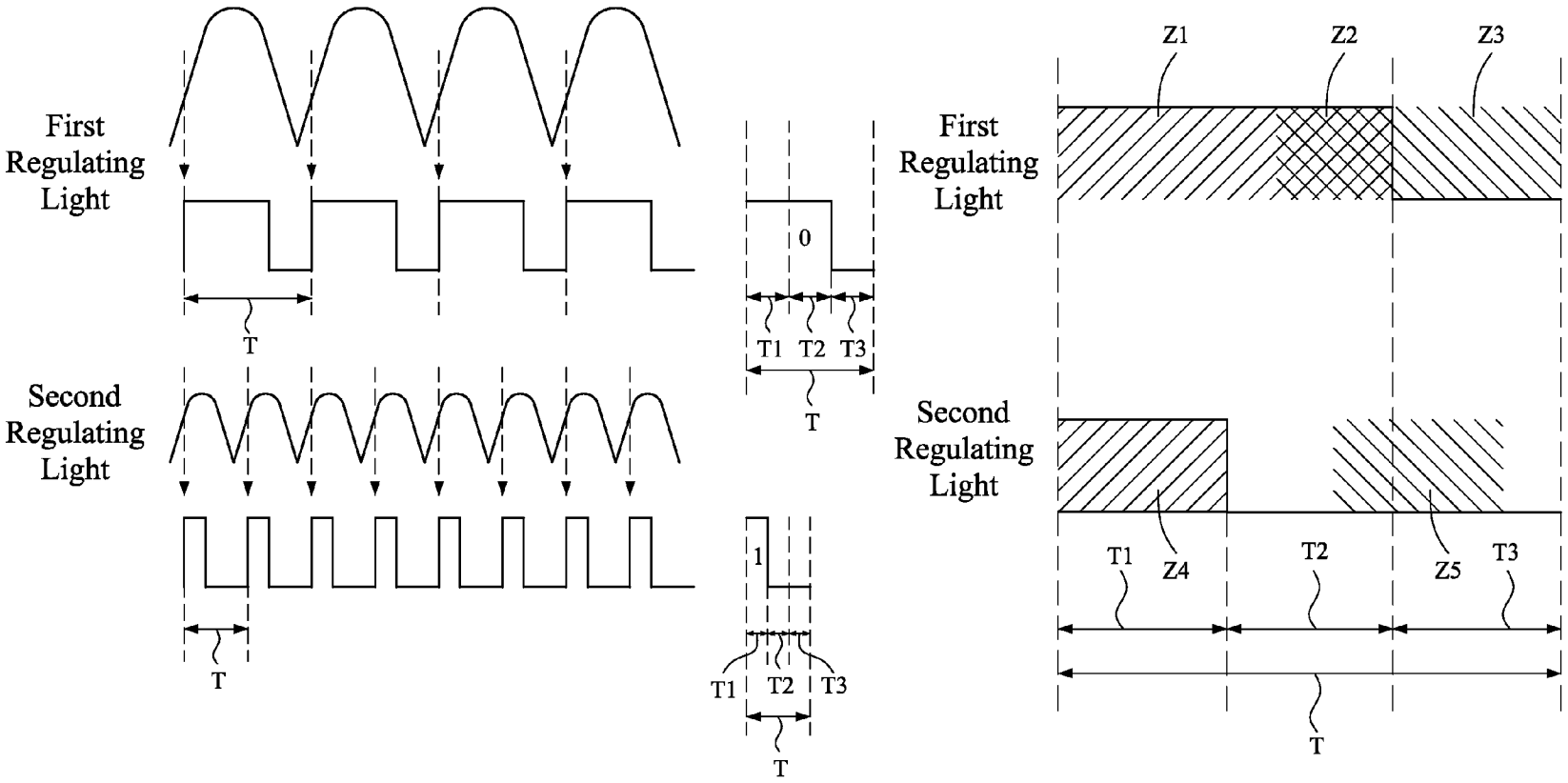
FIG. 7A is a schematic diagram of the carrier wave of the regulating light and the noise determination of the regulating light according to the present invention.
Figure 7B:
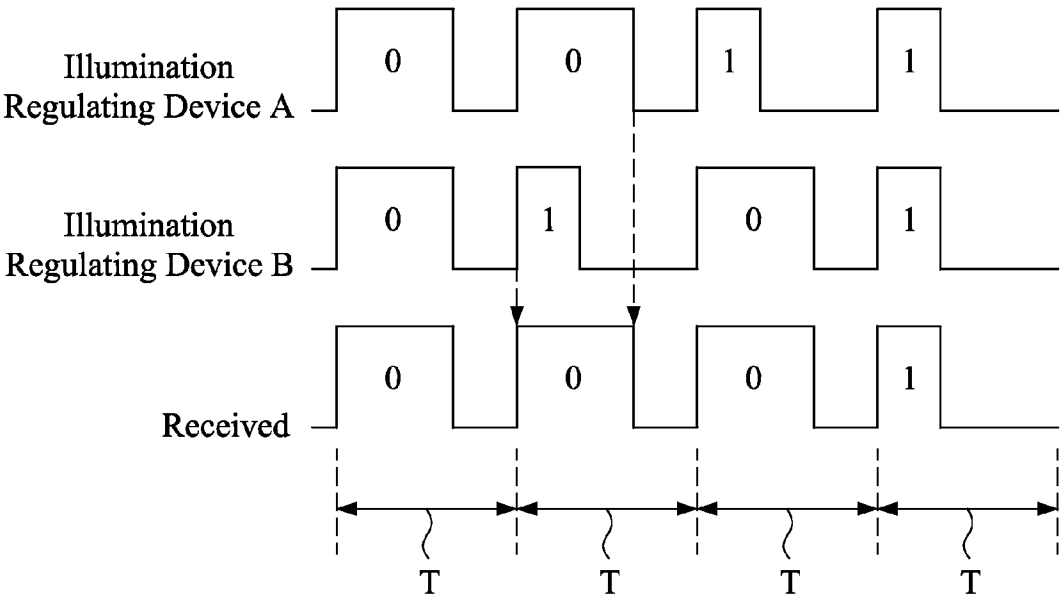
FIG. 7B is a schematic diagram of determining the arbitration priority according to the present invention.

Please refer to FIG. 7A and FIG. 7B, which show how to take an alternating current power frequency as the reference criteria to determine the priority in the process of arbitration and to determine the noise. As depicted in FIG. 7A, for example, the T (bit width) of the wave pattern of the carrier wave is based on 60 Hz/50 Hz as the reference criteria for the light source to perform effective bit value determination. For example, if the ratio of carrier wave (segment T1-T2) to carrier free (segment T3) of the first regulating light within a bit width T is 2:1, then the bit value is "0". If the ratio of carrier wave (segment T1) and carrier free (segment T2-T3) of the second regulating light within a bit width T is 1:2, then the bit value is "1". The logic symbol "AND" is the method of the determining the priority adopted by the arbitration mechanism, especially when a plurality of the illumination regulating devices 1 simultaneously emit regulating lights L1. Specifically, as depicted in FIG. 7B, the received result equals the bit value sent by illumination regulating device A "AND" the bit value sent illumination regulating device B. For example: when in the light receiving step (step S10), the two illumination regulating devices A, B transmit the switch group addresses (data-identification bit) simultaneously, which are the switch group address of the illumination regulating device A: 0x05(00000101b), and the switch group address of the illumination regulating device B 0x03 (00000011b) respectively. In the light receiving step (step S10), the sequence of transmission is from bit7 (MSB) to bit0 (LSB). While transmitting bit data, the illumination regulating device read back the bit data simultaneously, so as to determine whether the bit data read back are the same with the bit data transmitted. If they are not the same, then it represents that the regulating priority is lost, and the illumination regulating device will turn into a regulated device 2, subsequently receiving the data sent by the illumination regulating device 1. In this example, the transmission begins from bit7. When the transmission reaches bit2, the bit value transmitted by the illumination regulating device A is "1", while the bit data read back is "0" (with the logic symbol AND→1 & 0=0). So the illumination regulating device A turns into a regulated device 2 and receives the subsequent data, and the illumination regulating device B keeps transmitting and is not affected. It can thus be derived that the lower address takes priority over the higher address. The transmitting address (data-identification bit) is used as an example above. The priority of determination of the whole optical transmission frame F is: the command bit (F3)→the data-identification bit (F4)→the data bit (F5) →the calibration bit (F6). The determination of noise is performed by sending the regulating light L1 by way of the luminous element, and then reading back the data from the light detector for comparing the data read back with the original data. If there are more than two illumination regulating devices 1 sending the regulating light L1 simultaneously, then whether one of them is a noise can be determined by way of the comparison between the read back data and the original data. For example, as depicted in FIG. 7A, after the noise determination, we can tell that the segment (Z1-Z2) of the first regulating light within a bit width T includes the carrier wave, the segment (Z2-Z3) includes the noise, the segment Z4 of the second regulating light within a bit width T includes the carrier wave, and segment Z5 includes a noise.

In the above embodiments, the illumination regulating method of the present invention can further include a group setting step, which is a step of setting a plurality of illumination regulating devices 1 and a plurality of regulated devices 2 as belonging to a designated power switch group and/or a designated remote control device group by means of switching the power switch 3. Alternatively, the group setting step is a step of setting a plurality of illumination regulating devices 1 and a plurality of regulated devices 2 as belonging to a designated power switch group and/or a designated remote control device group by means of operating a remote control device. More specifically, each light source and remote control device includes a default switch group address (and/or a remote control device group address). When performing the power switching via the power switch 3, those light sources (or remote control devices) that had already joined the switch group (and/or the remote control device group) will emit the regulating light L1 to make the newly established light sources (or remote control devices) join the switch group (and/or the remote control device group). Alternatively, after the switch group being switched on via the power switch 3, the newly established light sources (or remote control devices) will emit the regulating light L1 to ask for joining the switch group (and/or remote control device group). Alternatively, when performing operation via the remote control device, those light sources (or remote control devices) that had already joined the switch group (and/or the remote control device group) will emit the regulating light L1 to make the newly established light sources (or remote control devices) join the switch group (and/or the remote control device group). Further alternatively, after operating the remote control device, the newly established light sources (or remote control devices) will emit the regulating light L1 to ask for joining the switch group (and/or remote control device group).

Besides, except for using the power switch 3, we can also use the remote control device to directly set all the light sources and/or the remote control devices in a switch group. Moreover, except for using the remote control device, the power switch 3 can also be used to set directly all the light sources and/or the remote control devices in a remote control device group. It is noticeable that, between/among different switch groups or remote control devices, we can redirect the optical transmission frame F to other adjacent light source or remote control device for extending the transmitting distance/range and eliminating the dead corner.

Furthermore, when a light source (or remote control device) that is not disposed with a switch group receives the regulating light L1 of certain light source (or certain remote control device), it will join the switch group of the light source (or the remote control device) immediately, and only the illumination regulating device 1 that belongs to the same switch group can control this light source (or remote control device). If the light source (or remote control device) wants to leave the switch group, the original switch group address of the light source must be erased by an illumination regulating device 1 for the light source (or remote control device) to join other switch groups. Similarly, when a light source (or remote control device) that is not disposed with a remote control device group receives the regulating light L1 from certain light source (or certain remote control device), it will join the remote control device group of the light source (or remote control device) immediately, and only the illumination regulating device 1 that belongs to the same remote control device group can control this light source (or remote control device). If the light source (or remote control device) wants to leave the remote control device group, the original remote control device group address of the light source must be erased by an illumination regulating device 1 for the light source (or remote control device) to join other remote control device group.

The above description is only an explanation of the preferred embodiments of the present invention. A person with ordinary skill in the art can make various improvements according to the above description. However, those modifications shall still fall within the scope of the patent protection of the present invention defined as follows.

What is claimed is:

1. An illumination regulating system which is operated in synchronization with an alternating current power frequency, comprising:

an illumination regulating device, which is a light source device and a remote control device, and which is provided with a luminous element; and a regulated device, which is a light source device and a remote control device, and which is provided with a light detector that receives a regulating light emitted from the luminous element of the illumination regulating device in such a manner that the regulated device is controlled by the illumination regulating device, wherein the illumination regulating device and the regulated device perform wireless data transmission in synchronization with an alternating current power frequency;

wherein the data transmission between the luminous element and the light detector is performed by using an optical transmission frame of the regulating light, the light source is provided with a light source recognition data, and the remote control device is provided with a remote control recognition data, and wherein the data transmission between the illumination regulating device and the regulated device includes:

a data transmission between one regulated device and one illumination regulating device, a data transmission among one regulated device and a plurality of illumination regulating devices, a data transmission among a plurality of regulated devices and one illumination regulating device, and a data transmission among a plurality of regulated devices and a plurality of illumination regulating devices.

2. The illumination regulating system as claimed in claim 1, wherein the regulated device belongs to one or more groups, in which the group is a power switch group or a remote control group.

3. The illumination regulating system as claimed in claim 2, wherein the light source and the remote control device are provided as a routing device which is connected between different groups of regulated devices to regulate the regulated devices of different groups.

4. The illumination regulating system as claimed in claim 2, wherein the light source and the remote control device are provided as a bridging device which is for connecting the illumination regulating device and the regulated device to an external network.

5. The illumination regulating system as claimed in claim 1, wherein the regulated device is controlled by the illumination regulating device by means of transmission starting point determination, synchronization, arbitration and transmission error determination.

6. The illumination regulating system as claimed in claim 5, wherein the arbitration is for determining the regulating priority of each illumination regulating device by comparing the optical transmission frame of each luminous element.

7. The illumination regulating system as claimed in claim 1, wherein the setting or transferring a set of characteristic parameter of the light source is performed between the illumination regulating device and the regulated device, or is performed between the regulated devices.

8. The illumination regulating system as claimed in claim 1, further comprising a monitoring means which is provided for monitoring the data status of the illumination regulating device and the regulated device.

9. The illumination regulating system as claimed in claim 1, wherein the remote control device of the illumination regulating device is with functionality to measure brightness and illuminance of the luminous element of the regulated device, or with functionality to regulate the luminous element of the regulated device by receiving a signal transmitted from an external network.

10. An illumination regulating method which is operated in synchronization with an alternating current power frequency, comprising:

a light receiving step of receiving, by a light detector of a regulated device, a regulating light emitted from a luminous element of a illumination regulating device, wherein the regulating light, which performs wireless transmission between the illumination regulating device and the regulated device by transmitting an optical transmission frame of the regulating light, is in synchronization with an alternating current power frequency; and a light controlling step of enabling the regulated device to be controlled by the illumination regulating device according to the data of the regulating light, wherein the data transmission between the illumination regulating device and the regulated device includes:

a data transmission between one regulated device and one illumination regulating device, a data transmission among one regulated device and a plurality of illumination regulating devices, a data transmission among a plurality of regulated devices and one illumination regulating device, and a data transmission among a plurality of regulated devices and a plurality of illumination regulating devices.

11. The illumination regulating method as claimed in claim 10, wherein in the light controlling step, the regulated device is controlled by the illumination regulating device by means of transmission starting point determination, synchronization, arbitration and transmission error determination.

12. The illumination regulating method as claimed in claim 11, wherein the arbitration is for determining the regulating priority of each illumination regulating device by comparing the optical transmission frame of each luminous element.

13. The illumination regulating method as claimed in claim 10, wherein in the light controlling step, the illumination regulating device and the regulated device are regulated by connecting the illumination regulating device and the regulated device to an external network.

14. The illumination regulating method as claimed in claim 10, wherein in the light receiving step, the data transmission between different groups of the illumination regulating device and the regulated device is performed by configuring the light source and the remote control device as a routing device.

15. The illumination regulating method as claimed in claim 10, wherein in the light receiving step, the data status of the illumination regulating device and the regulated device is monitored.

16. The illumination regulating method as claimed in claim 10, further comprising a data transferring step, wherein the data transferring step is a step of setting or transferring the characteristic parameters of the light source device between the illumination regulating device and the regulated device, or between the regulated devices.

17. The illumination regulating method as claimed in claim 10, further comprising a brightness measuring step, wherein the brightness measuring step is a step of performing brightness and illuminance measurement on the luminous element of the regulated device and displaying the results of the brightness and the illuminance measurement.

18. The illumination regulating method as claimed in claim 10, further comprising a group setting step, wherein the group setting step is a step of setting a plurality of illumination regulating devices and a plurality of regulated devices as belonging to a designated power switch group and a designated remote control device group.

19. The illumination regulating method as claimed in claim 10, further comprising, before the light receiving step, a carrier wave modulating step of modulating the carrier wave frequency of the regulating light based on the alternating current power frequency.

20. The illumination regulating method as claimed in claim 10, further comprising a carrier wave demodulating step of demodulating the carrier wave frequency of the regulating light based on the alternating current power frequency and performing wave filtering to filter the carrier wave.

* * * * *